US005665940A

United States Patent [19]

Chimura et al.

[11] Patent Number: 5,665,940

[45] Date of Patent: Sep. 9, 1997

[54] FLAT CABLE

[75] Inventors: Shigeki Chimura, Kariya; Masato Kamino, Toukai, both of Japan

[73] Assignee: Nippondenso Co., Ltd, Kariya, Japan

[21] Appl. No.: 468,562

[22] Filed: Jun. 6, 1995

[30] Foreign Application Priority Data

Jul. 1, 1994 [JP] Japan ..... 6-150957
Nov. 9, 1994 [JP] Japan ..... 6-275235

[51] Int. Cl.[6] ..... H01B 7/02

[52] U.S. Cl. ..... 174/116; 174/117 F

[58] Field of Search ..... 174/117 F, 117 M, 174/117 AS, 117 A, 113 R, 116

[56] References Cited

U.S. PATENT DOCUMENTS

| | | | |
|---|---|---|---|
| 919,384 | 4/1909 | Runzel | 174/117 F |
| 1,668,699 | 5/1928 | Saylor | 174/117 F |
| 2,264,439 | 12/1941 | Guyatt | 174/117 F |
| 2,315,736 | 4/1943 | Rosch | 174/117 F |
| 3,458,650 | 7/1969 | Miyawaki et al. | 174/117 F |
| 4,532,374 | 7/1985 | Neuroth | 174/117 F |
| 4,943,688 | 7/1990 | VanDeusen et al. | 174/117 F |
| 5,342,997 | 8/1994 | Kanno et al. | 174/117 F |

FOREIGN PATENT DOCUMENTS

| | | |
|---|---|---|
| 2168513 | 6/1990 | Japan . |
| 5-83951 | 11/1993 | Japan . |
| 518098 | 2/1940 | United Kingdom . |

*Primary Examiner*—Kristine L. Kincaid
*Assistant Examiner*—Marc Machtinger
*Attorney, Agent, or Firm*—Cushman, Darby & Cushman

[57] ABSTRACT

A flat cable has a plurality of parallelly disposed fine-conductive wires and insulating wires. The conductive wires are divided by the insulating wires into channels which are respectively connected to terminals of different devices. The channels may be arranged easily by changing the interposing position of the insulating wires. Since the conductive wires have a fixed resistance, desired resistance may be obtained by only increasing or decreasing the number of the conductive wires in a channel.

15 Claims, 13 Drawing Sheets

FLAT CABLE

CROSS REFERENCE TO RELATED APPLICATION

The present application is based on and claims priority from Japanese Patent Applications No. Hei 6-150957 filed on Jul. 1, 1994, and No. Hei 6-275235, filed on Nov. 9, 1994, the contents of which are incorporated herein by reference.

BACKGROUND OF THE INVENTION

1. Field of the Invention

The present invention relates to a flat cable, and particularly relates to a plurality of flat cable members forming a channel having an appropriate value of the electric resistance for transmitting electrical signals and/or electric power to various devices of a vehicle.

2. Description of the Related Art

A flat cable is well known in the art as is disclosed in Japanese Utility Model Un-examined Publication No. Hei 5-83951. The conventional flat cable or micro wire referred to in the publication includes a plurality of aligned enamel-insulated-wires 105 each of which connects different one of devices, a resinous holder member 103, film covers 101 and adhesive agent 102 for protecting the wires 105 as shown in FIG. 20. The above structure has brought about easy wiring as well as high-density fine-pitch wiring.

However, it has been required recently that many terminals of various electric devices must be connected in a limited space such as an engine compartment of a vehicle. For instance, a flat cable for supplying electric power to numbers of devices such as an inflator of an airbag, an electric horn and/or a cruise controlling system is required to have a limited cable width. However, if the micro wire disclosed in the above unexamined publication is attempted for use in such devices and/or a system, the width cannot be narrowed enough to fit it in the limited space because the horn requires large power and each conductive wire of the micro wire needs to have bulky conductive members although other components do not require such large power.

SUMMARY OF THE INVENTION

The present invention is made in view of the foregoing problems, and has a primary object of providing a compact cable unit which supplies power effectively according to required power for various electric devices and systems.

If a plurality of conductive wires of a conventional flat cable are divided into numbers of channels to connect various electric devices and/or information transmission systems, i.e., by fusion welding, a certain number of the conductive wires must be cut as shown in FIGS. 21 and 22 in order to have a space 106 for the connection to a number of terminals. The cutting has to be carefully made by a laser machine or the like in order to ensure electric insulation. The connection of the wires with a couple of terminals 107 made by fusion welding is shown in FIG. 23. An electrode 108 has a recess so that it may not flatten the cut wire at the space 106. The cut wire is no use except for providing a space and is almost wasteful.

Therefore, another object of the present invention is to provide an improved flat cable having a plurality of aligned conductive wires which can be divided into numbers of channels for appropriate connection with various devices and/or systems, and it does not require a fine cutting process, a cutting machine, a specific fusion welding electrode, or wasting of wires.

Another object of the present invention is to provide an improved flat cable including at least one insulation wires and a plurality of extrafine conductive-wires which are grouped by the insulation wires to form channels having desired resistance for connecting various devices and/or systems respectively.

A further object of the present invention is to provide an improved flat cable including insulation wires disposed between the channels to ensure the insulation between channels without insulation coatings of the conductive wires.

A further object of the present invention is to provide an improved flat cable including insulation wires disposed outside the conductive wires of channels as well as between the channels so that the channels are protected from suffering damage from the outside.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENT

Preferred embodiment according to the present invention will now be described with reference to the appended drawings.

Figure 1:
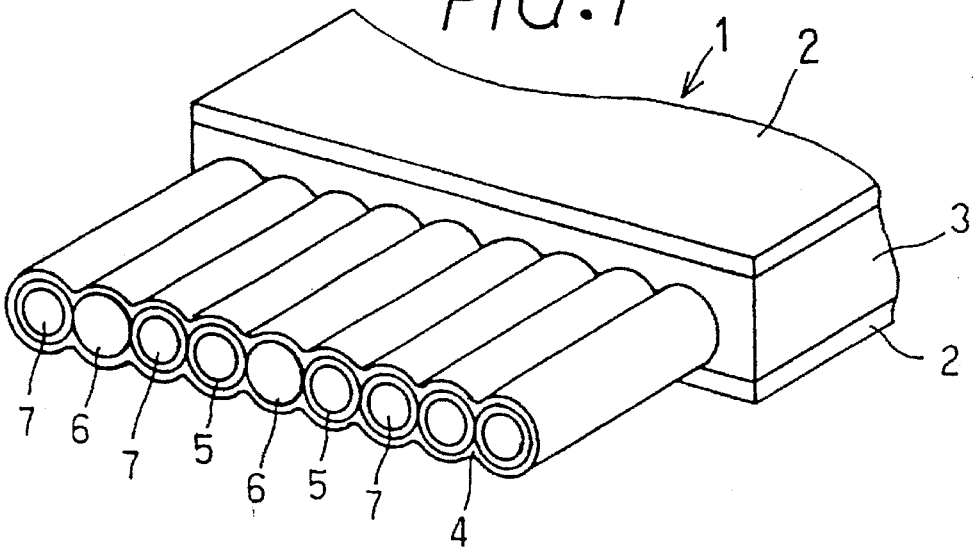
FIG. 1 is a perspective view illustrating a flat cable according to a first embodiment of the present invention.

A flat cable 1 according to a first embodiment of the present invention is illustrated in FIG. 1. In FIG. 1, a plurality (seven in this embodiment) of conductive wires 7 are covered by insulation coatings 5 and a plurality (two in this embodiment) of insulating wires 6 having substantially the same diameter as the conductive wires 7 are interposed between the conductive wires 7 and aligned therewith. Each of the conductive wires 7 has a fixed value of the electric resistance. Insulating wires 6 are made of synthetic resinous material such as polyamide, and each of the insulating wires 6 divides the conductive wires 7 into a number (three in this embodiment) of groups or channels (hereinafter referred to as channels). Of course, a plurality of the insulation wires 6 may be disposed between channels if some adjustment of the space between the channels is necessary for connection. The insulating wires 6 and the conductive wires 7 are covered and held by a holder member 4 to form a flat-board shape, which is subsequently covered by films 2 and an adhesive agent 3. The films 2 and the adhesive agent 3 are flexible and protect the conductive wires 7 from injury.

A manufacturing process of the flat cable 1 according to the first embodiment is explained next with reference to FIG. 2 and FIG. 3.

Figure 2:
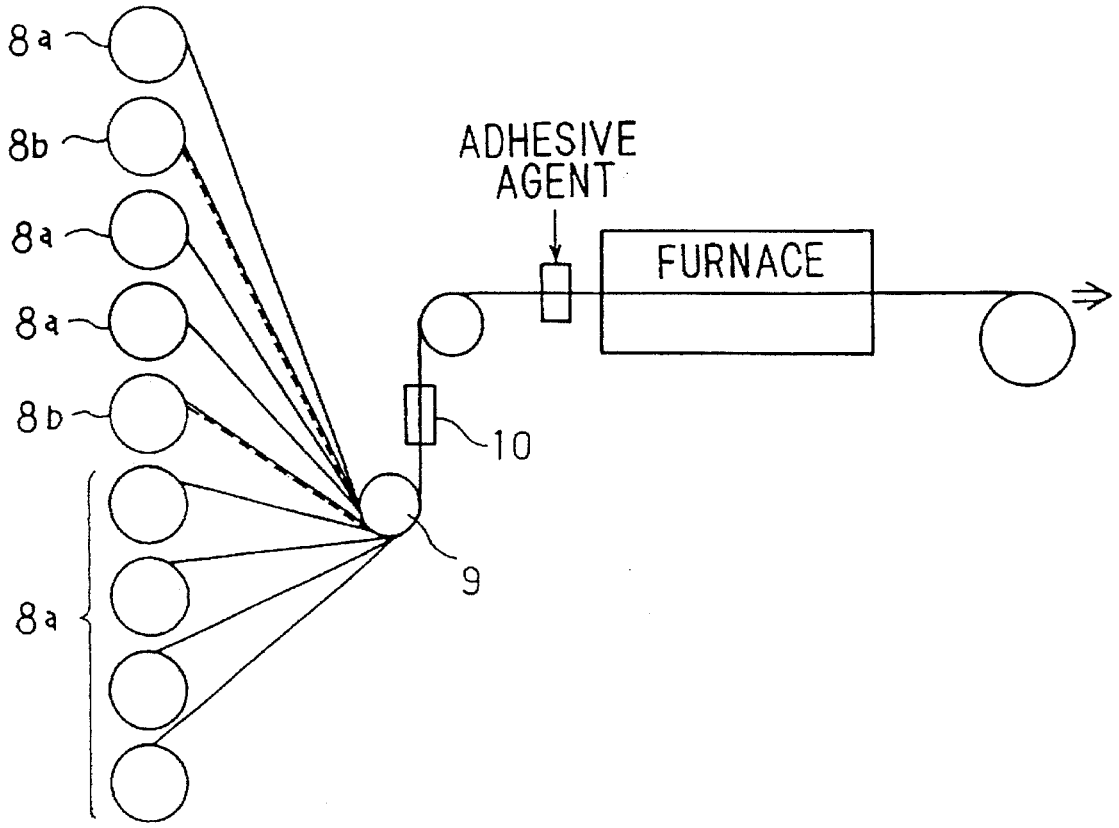
FIG. 2 is a schematic view illustrating a manufacturing process of the flat cable according to the first embodiment of the present invention.
Figure 3:
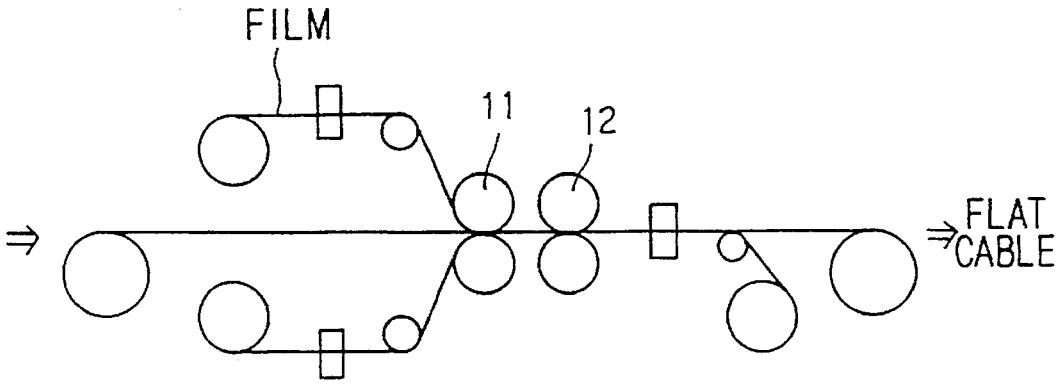
FIG. 3 is a schematic view illustrating a manufacturing process of the flat cable according to the first embodiment of the present invention.

In FIG. 2, each of the conductive wires 7 is wound in a coil 8*a*, and each of the insulating wires is also wound in a coil 8*b*. Each of the conductive wires 7 and the insulating wires 6 is taken from each of the coils 8*a* and 8*b* to a rotor 9. The position of the coils 8*a* and 8*b* is set according to the channel pattern of the flat cable 1. In this case, the coils 8*b* of the insulating wire 6 are placed at the second and fifth position of the coils in order to manufacture the flat cable 1 shown in FIG. 1.

Then, all the wires 6 and 7 are introduced by the rotor 9 into an arranging device 10, which aligns the wires 6 and 7 into a uniform and flat-board. Thereafter, the surfaces of the wires 6 and 7 are coated with synthetic resinous material and heated to form the holder member 4. The wires covered by the holder member 4 are, subsequently, sent to a laminating roller 11, where two sheets of the films 2, each of which has adhesive agent on a side, are pressed on upper and bottom surfaces of the holder member 4. Thus, the flat cable 1, which is a lamination of a plurality of the aligned conductive wires 7, the insulation wires 6 and the film 2, is obtained.

Figure 5:
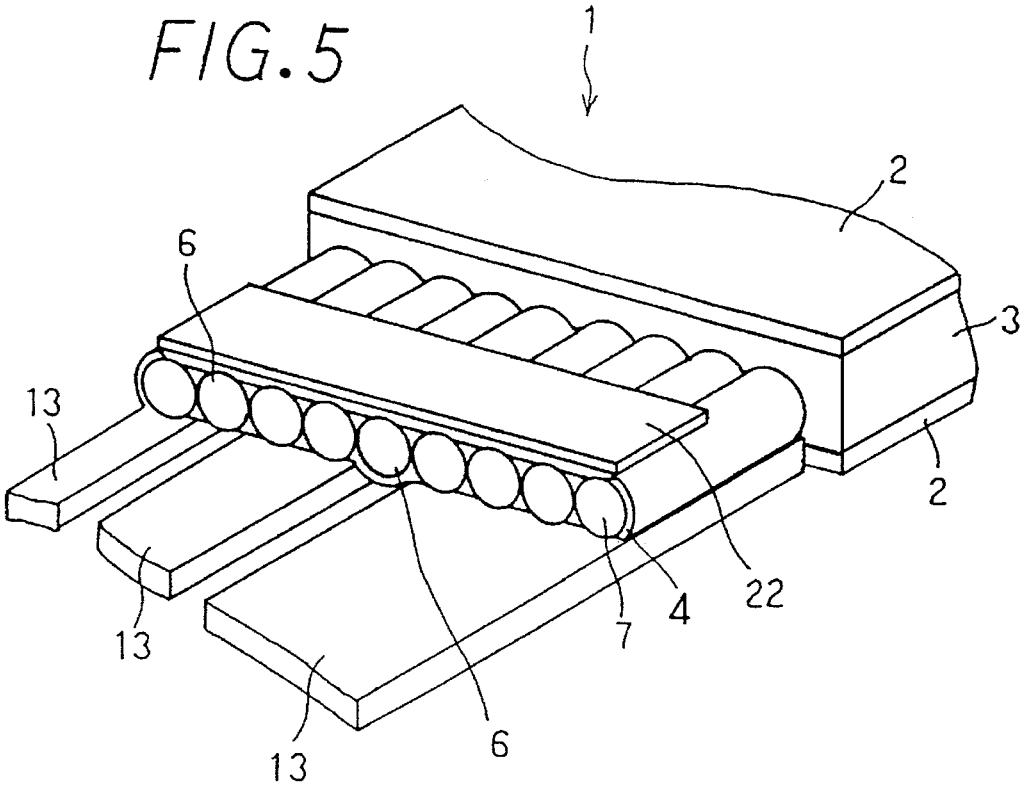
FIG. 5 is a perspective view illustrating the connection of the flat cable according to the first embodiment to terminals of devices by fusion welding.
Figure 6:
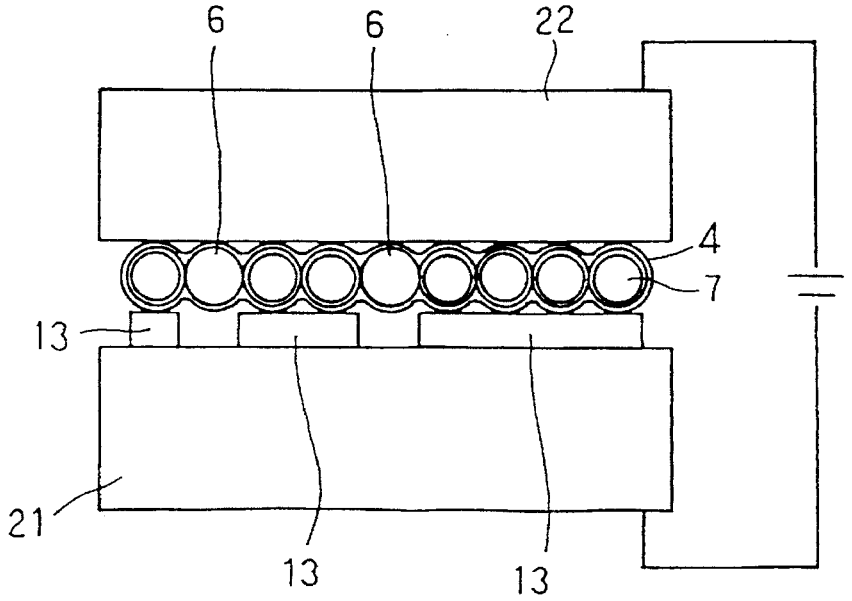
FIG. 6 is a schematic side view illustrating the flat cable according to the first embodiment in a fusion welding process.
Figure 7:
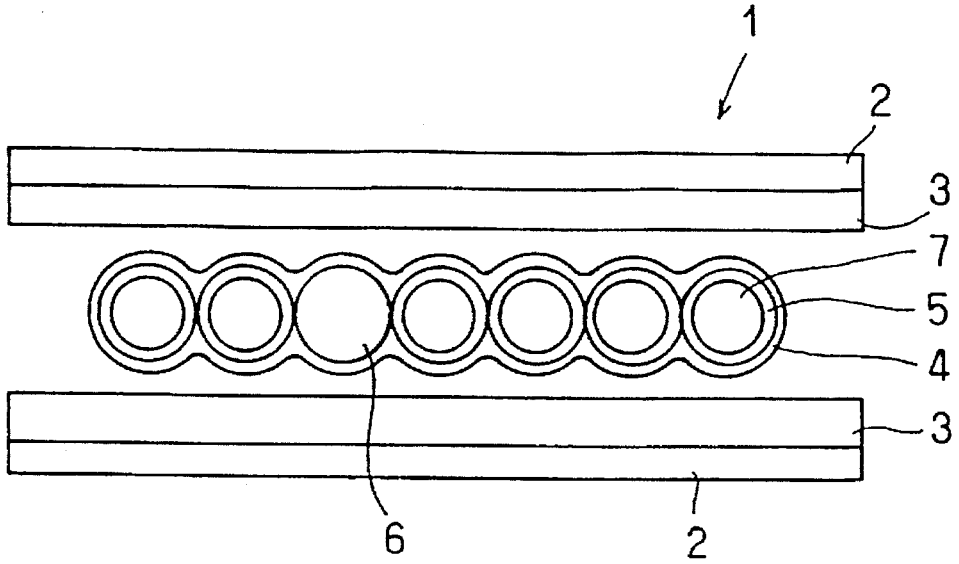
FIG. 7 is a schematic side view illustrating the flat cable according to the first embodiment in a laminating process.
Figure 8:
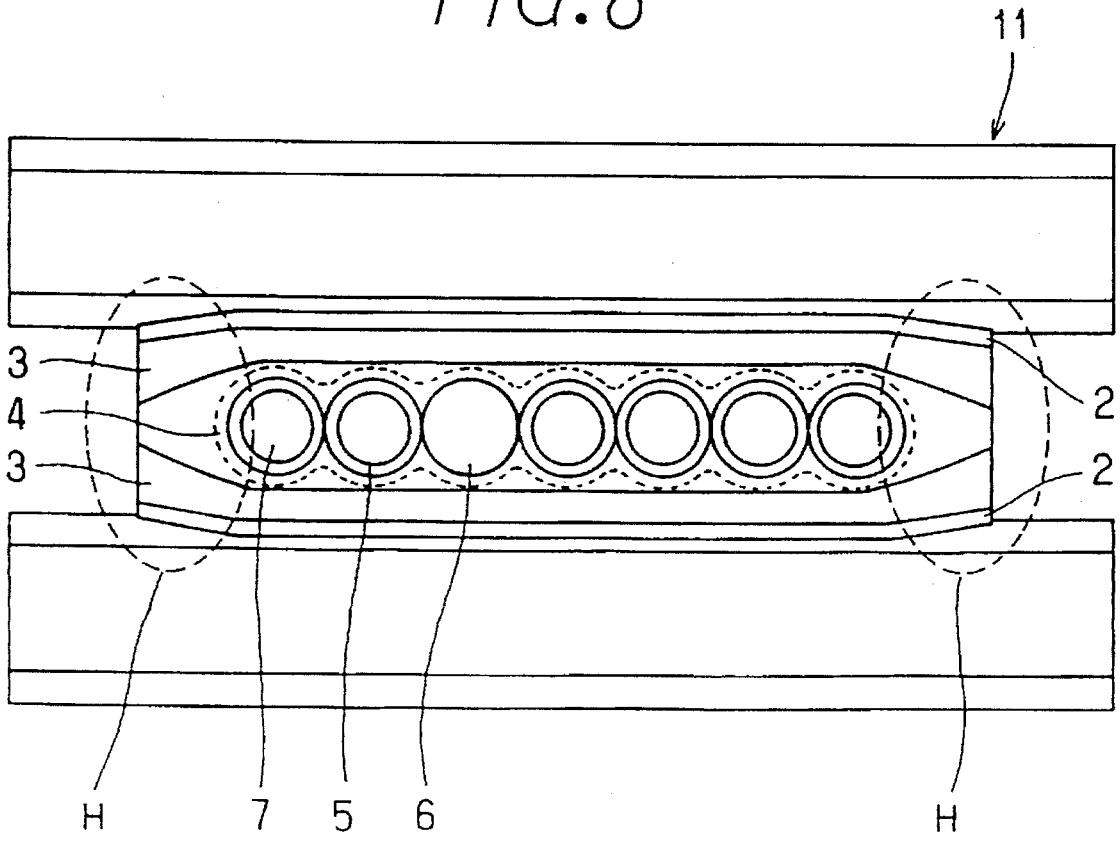
FIG. 8 is a schematic side view illustrating the flat cable according to a second embodiment of the present invention in a laminating process.

Connection of the flat cable 1 to some electric devices or systems will be explained with reference to FIGS. 4 through 6 next.

Figure 4:
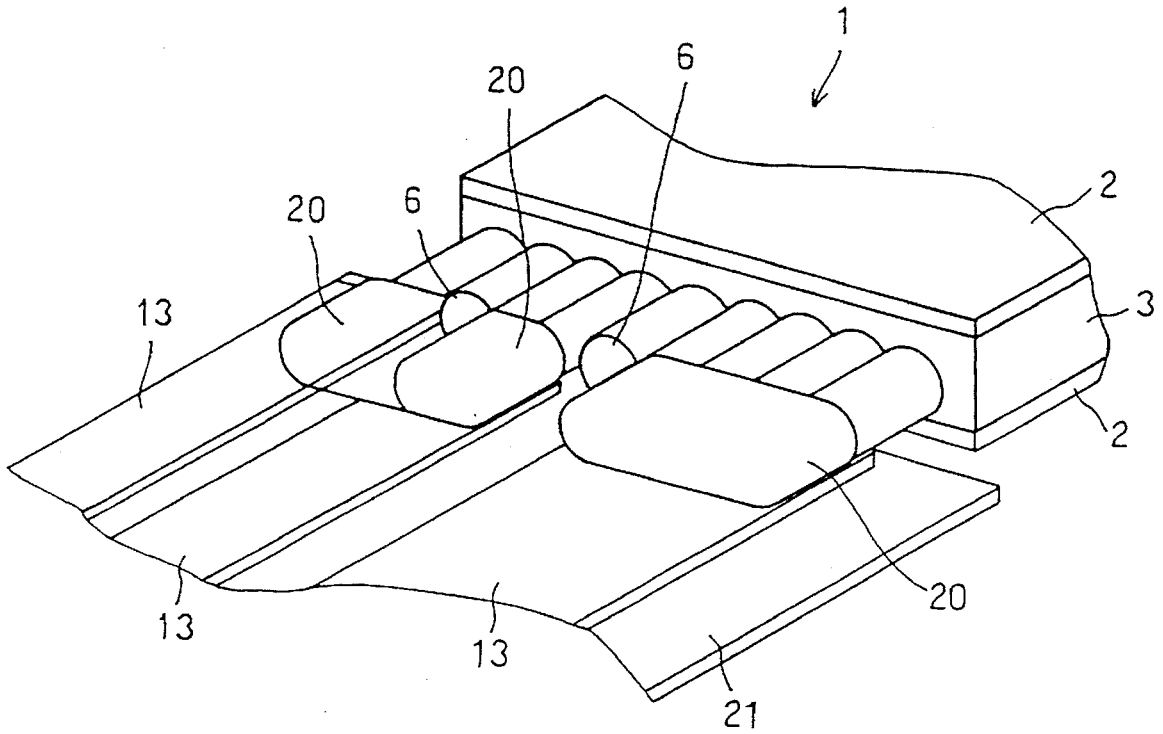
FIG. 4 is a perspective view illustrating the connection of the flat cable according to the first embodiment to terminals of devices by soldering.

In FIG. 4, the flat cable 1 of the first embodiment is electrically connected by way of soldering to terminals of some devices of a vehicle. As shown in FIG. 4, the flat cable 1 is placed on a control panel 21 so that naked surfaces (the pointed ends of the conductive wires 7 in this embodiment) of the conductive wire in each channel of the flat cable is soldered to each terminal 13 of the control panel 21 with solder 20. During the soldering, the conductive wires 7 are exposed to the soldering heat and the insulation coatings 5 may melt between the conductive wires. However, the insulation wires 6 hold the conductive wires in each channel insulated from those in neighboring channels.

The connection may also be established by fusion welding. In FIGS. 5, the flat cable 1 is placed on terminals 13 of some devices in the same manner as the above soldering process. A fusion welding electrode 22 which is made of conductive metal or the like is then pressed on the wires 6 and 7 through the holder member 4 strongly enough to break the holder member 4 so that the electrical connections of the electrode 22 to the conductive wires 7 and the terminals 13 completely establish. Incidentally, in case of the flat cable shown in FIG. 6, since the conductive wires 7 are insulated by the coatings 5, the fusion welding electrode 22 is pressed strongly enough to break the coatings 5 as well as the holder member 4, as a matter of course. At the same time, a fusion voltage is applied between the electrode and the terminals 13, and fusion-heat temperature is generated because of resistance of the terminal 13 and the conductive wires 7, thereby establishing the electrical connection of the conductive wires and the terminals.

Since the insulation wires 6 are not placed on the terminals 13, they are not exposed to the fusion-heat and remain solid. The insulation wires 6 prevent the conductive wires 7 in a channel from being connected to a wrong terminal (neighboring terminal). That is, the positioning of the flat cable 1 with respect to the terminals 13 does not require strict accuracy.

As described above, channels having desired resistance or capacity may be formed only by inserting one of the insulation wire 6 between the conductive wires 7 to be grouped in different channels. Therefore the flat cable 1, as a single member, may be used for connection between a plurality of devices and/or systems. In addition, different flat cables 1 having desired channels are manufactured only by changing the position of the coils 8*a* and 8*b* described previously and shown in FIG. 2. In other words, various flat cables 1 which have various characteristics can be manufactured in a single manufacturing line. Further, a plurality of connections between devices and/or systems are made at the same time by soldering or by fusion as described with reference to FIGS. 4 through 6.

A flat cable according to a second embodiment of the present invention is described with reference to FIGS. 7 through 13 next.

Figure 10:
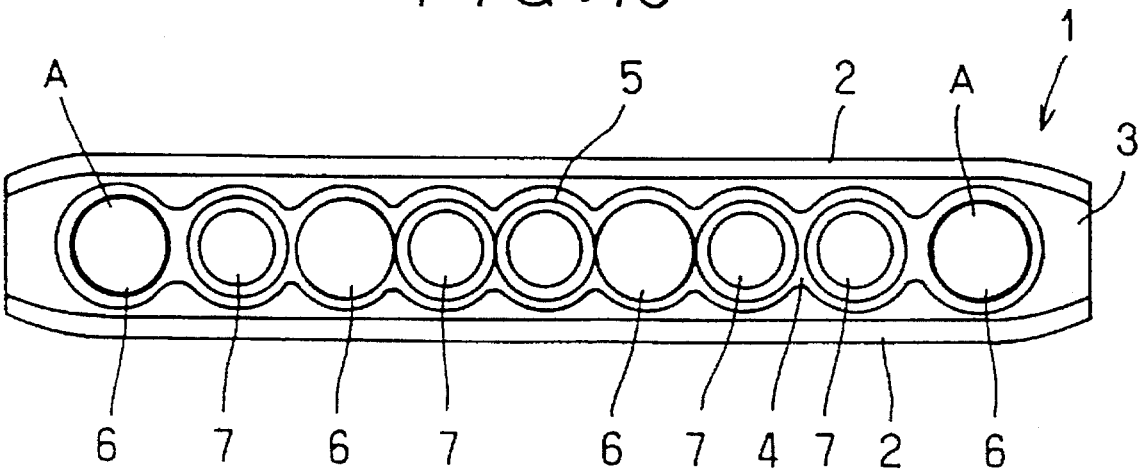
FIG. 10 is a schematic side view illustrating a flat cable according to a second embodiment of the present invention.

In FIG. 10, the flat cable 1 has insulating wires 6 on its both sides so that each channel including at least one of the conductive wires 7 is sandwiched by the insulating wires 6. The flat cable 1 is manufactured through substantially the same process described previously with reference to FIGS.

2 and 3. However, when the flat cable 1 is taken into the laminating roller 11 by the pulling roller 12, two sheets of the film 2 and the aligned wires 6 and 7 are pressed by elastic sheets such as rubber sheets which are coated on the laminating roller 11. As a result, both sides of the flat cable 1 are closed as encircled by dotted lines indicated by H in FIG. 8. This process is effective to hold the wires 6 and 7 to be close each other.

Figure 9:
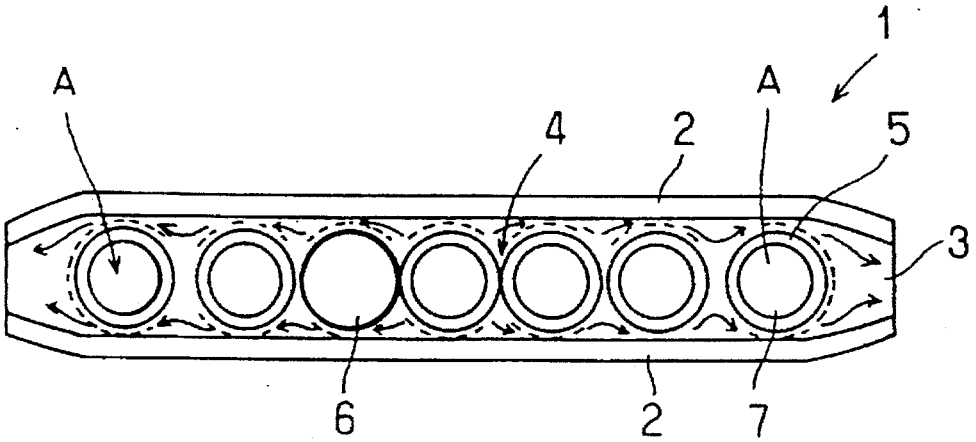
FIG. 9 is a schematic side view of the flat cable according to the second embodiment illustrating the material flow of holder-member material and adhesive agent.

When the film 2 and the wires 6 and 7 are pressed by the laminating roller under a temperature generally higher than room temperature, the holder member 4 may melt and lose the retaining force of the wires 6 and 7, resulting in that some (indicated by A) of wires 7 disposed outer portion of the flat cable leave the rest of the wires 6 and 7 as shown in FIG. 9 as the melting material of the holder member flows outward and in that the wires 7 left apart from the rests are subject to injury from the outside. Since the both sides of the flat cable are closed as described above, the melting material is prevented from flowing outward and all the wires are retained together.

However, as the outer wires 7 receive considerable pressure during the above laminating process, they may suffer damage to affect its resistance. In order to eliminate the problem, a flat cable 1 according to a second embodiment has the insulating wires 6 outside the conductive wires 7 as shown in FIG. 10.

Figure 11:
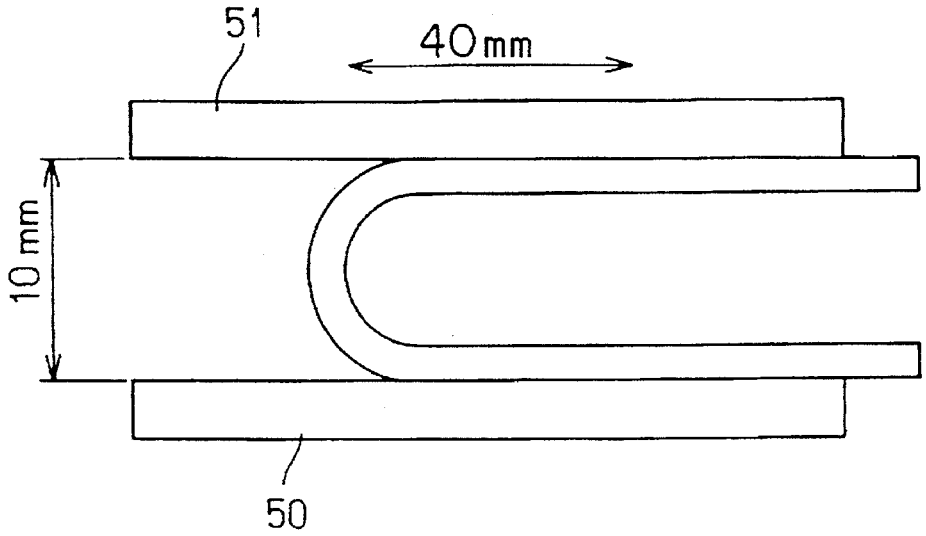
FIG. 11 is a schematic view of a bending test.
Figure 13:
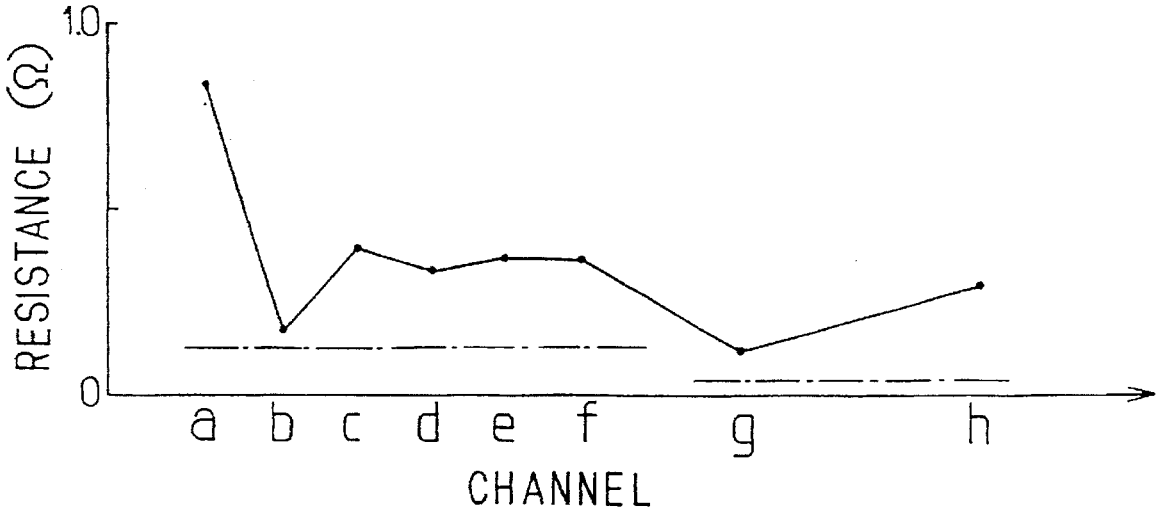
FIG. 13 is a graph showing each of the electric resistance values of the respective channels according to the first embodiment after the bending test.
Figure 12:
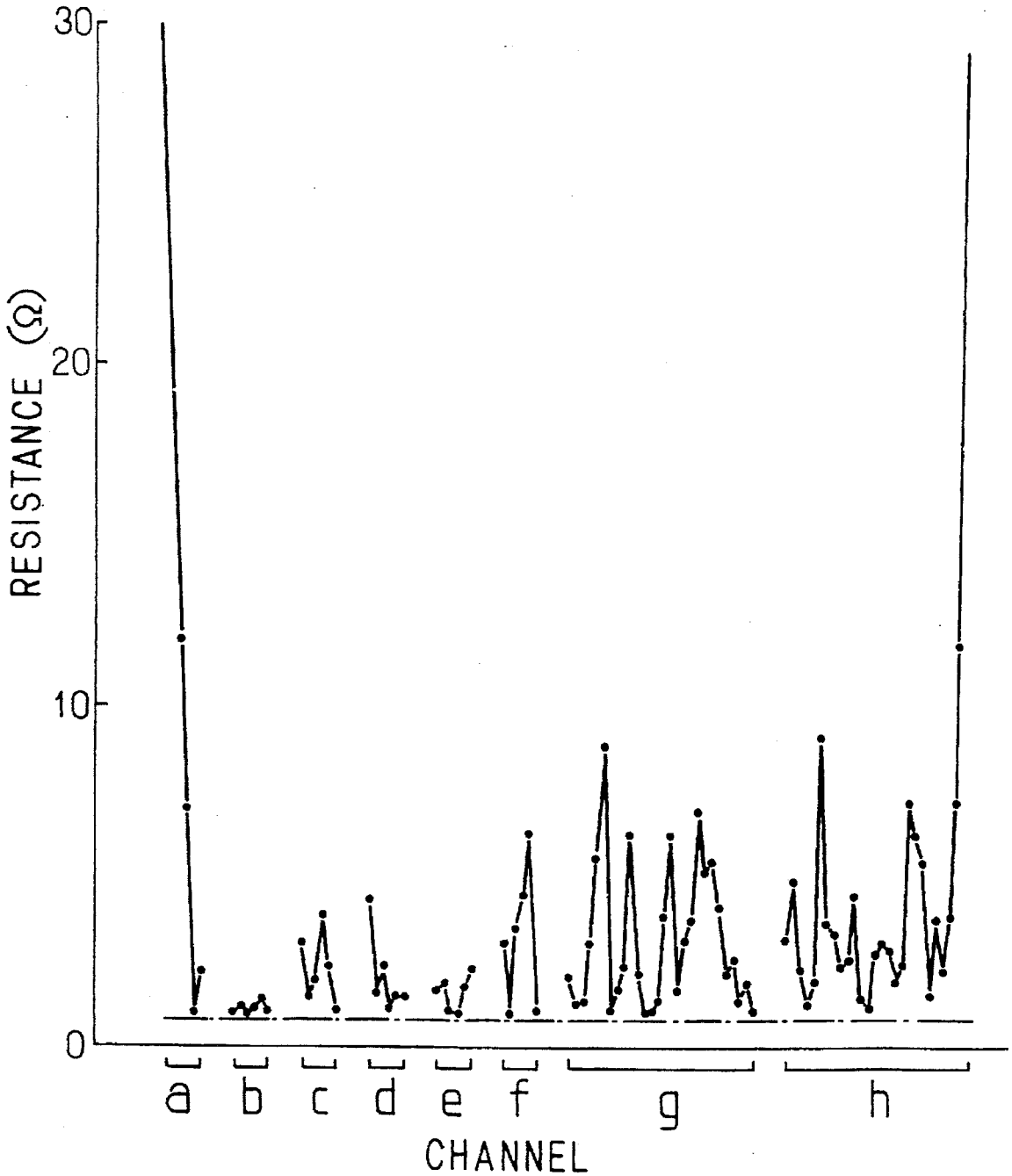
FIG. 12 is a graph showing each of the electric resistance values of conductive wires in respective channels of the flat cable according to the first embodiment after a bending test.

FIG. 11 illustrates a bending test machine, and FIGS. 12 and 13 show the results of the bending test. The flat cable which was tested has eight channels divided by the insulating wire 6 as indicated by 'a' through 'h'. Each of the first six channels thereof includes six conductive wires 7 and each of the rest two channels thereof has twenty eight (28) conductive wires 7. Therefore, the wires disposed outside the flat cable are the conductive wires 7 in this sample.

One longitudinal end of the flat cable is fixed to a stationary table 50 and the other end is bent into U-shape at a distance of about 10 mm and fixed to a moving table 51 as shown in FIG. 11. The moving table 51 reciprocates in parallel with the stationary table 50 along a stroke of 40 mm. FIG. 12 shows the resistance values of the conductive wires in the respective channels and FIG. 13 shows the resistance of the respective channels, after two million reciprocation of the moving table 51.

It is noted in FIGS. 12 and 13 that the outside conductive wires have been almost cut off, while the rest wires remain normal. That is, if the insulation wires 6 are disposed outside all the channels or all the conductive wires 7, the rest wires including the conductive wires 7 will remain normal even after such a severe test as above.

Figure 14:
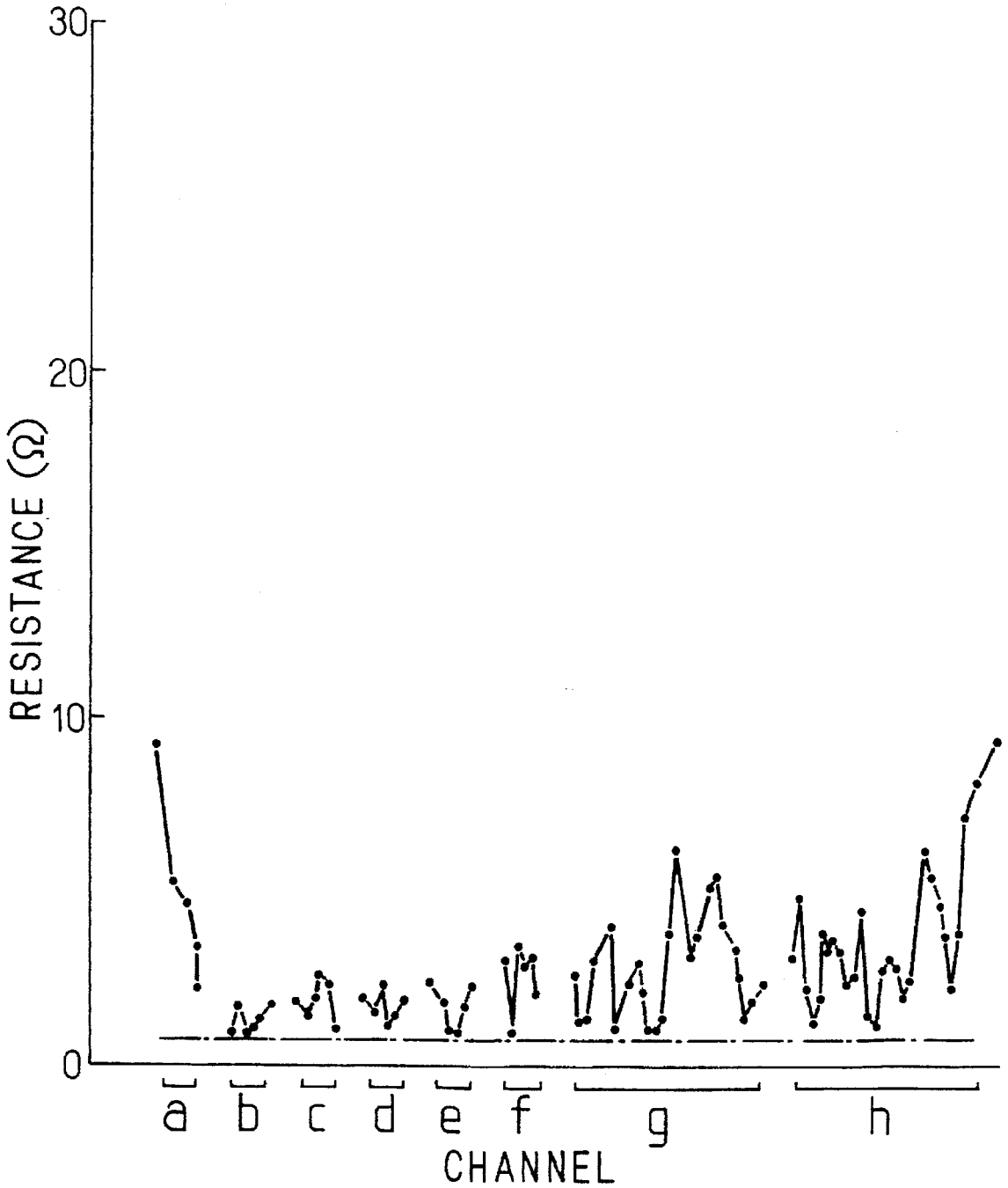
FIG. 14 is a graph showing each of the electric resistance values of conductive wires in the respective channels of the flat cable according to the second embodiment after a bending test.
Figure 15:
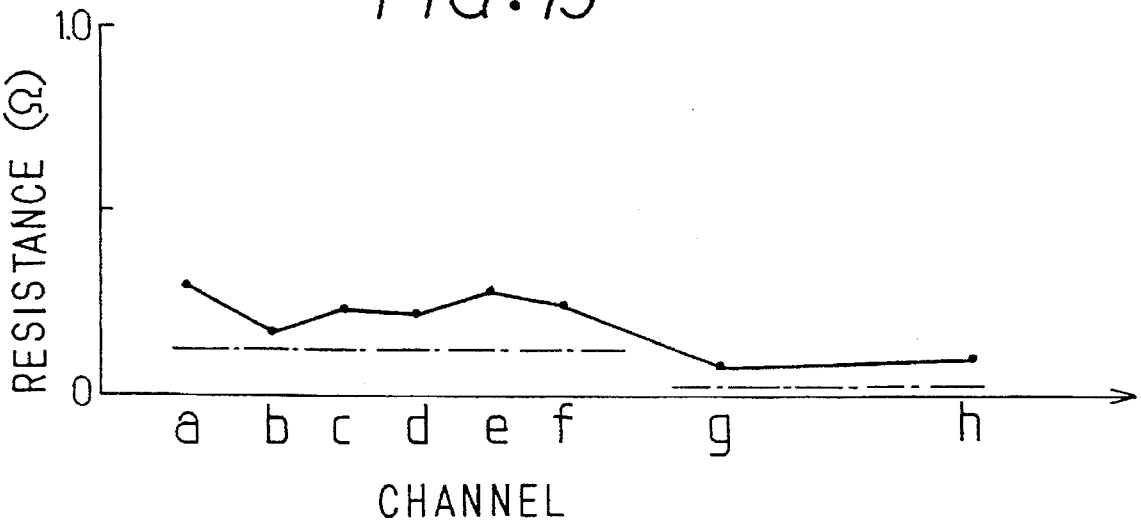
FIG. 15 is a graph showing each of the resistance values of the respective channels according to the second embodiment after the bending test.

FIGS. 14 and 15 show the result after the same test as the above has been given to the flat cable which has the insulation wires 6 disposed outside all the channels. It is noted that all the conductive wires 7 remain normal. Of course, more than one insulation wires 6 may be disposed at each outside portion of the channels as the case may be.

Figure 16:
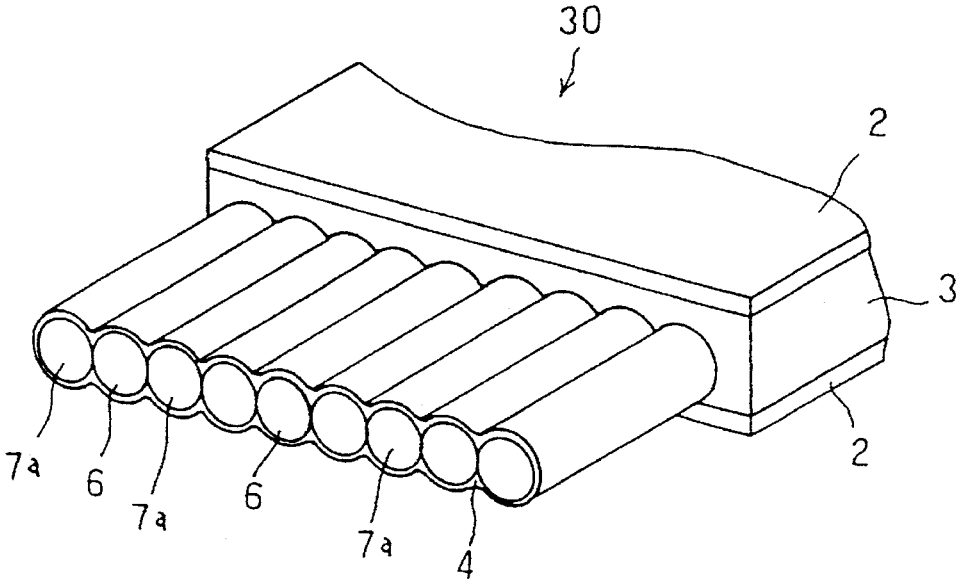
FIG. 16 is a perspective view illustrating a flat cable according to a third embodiment of the present invention.

FIG. 16 shows a flat cable 30 according to a third embodiment of the present invention. In this flat cable 30, conductive wires 7a have no such insulation coatings 5 as the wires 7 in the previous embodiment and each of the channels are insulated by the insulating wires 6.

The flat cable 30 may provide the insulating wires 6 outside all the conductive wires 7a as in the second embodiment described with reference to FIG. 10, and will have the same effect.

In order to provide more flexible flat cable, one of the film 2 may be omitted as far as circumstances permit. For example, when it is coiled and used in a steering pad of an automobile steering wheel, it is wound or rewound smoothly as the steering is operated.

Figure 17:
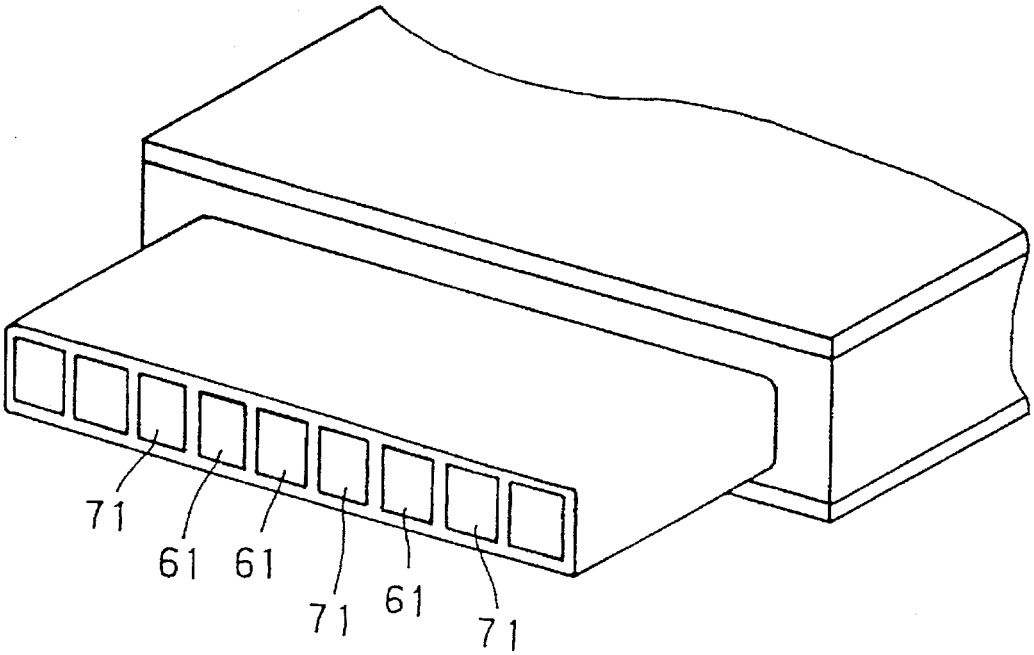
FIG. 17 is a perspective view illustrating a flat cable according to a fourth embodiment of the present invention.

FIG. 17 shows a flat cable according to a fourth embodiment of the present invention. The flat cable has rectangular insulation wires 61 and conductive wires 71 in this embodiment. However, the insulation wires 61 may have any cross-sectional shape, and the conductive wires 71 may have insulation coatings as the case may be. The flat cable may provide the insulating wires 61 outside the conductive wires 71 as in the second embodiment described with reference to FIG. 10, which will have the same effect.

In the previous embodiments, the holder member 4 is formed after the conductive and insulation wires 7 and 6 are aligned by the arrangement device 10, however it may be formed before the alignment.

Figure 18:
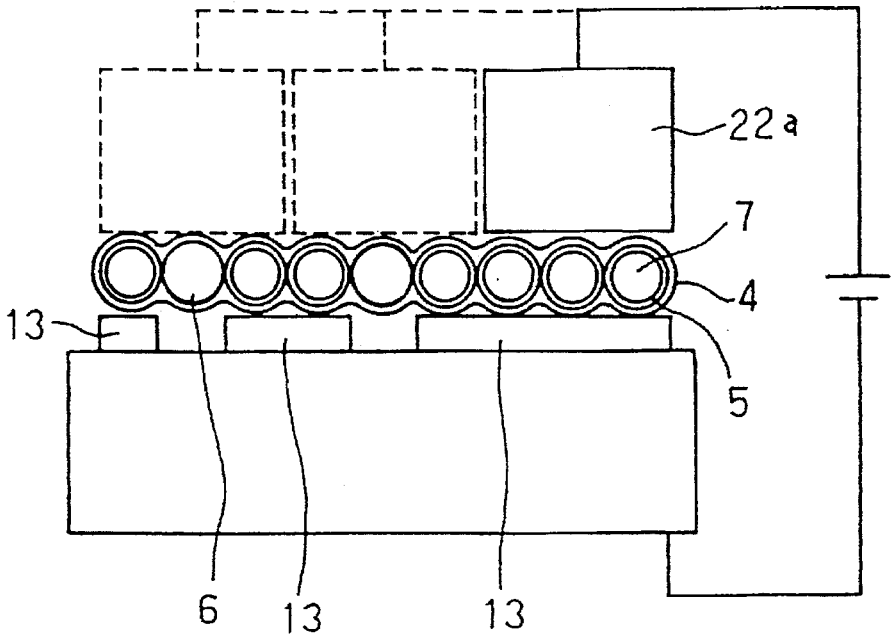
FIG. 18 is a perspective view illustrating the connection of the flat cable according to the present invention to terminals of devices by another way of fusion welding.

In the process of fusion welding of the flat cable and terminals of some devices, an electrode 22a having width which is narrower than the width of the flat cable 1 may be used as shown in FIG. 18. In this case, the fusion welding is carried serially by sliding the electrode 22a on the wires 7 and 6, and applying fusion voltage to the electrode 22a, for instance, three times as shown in FIG. 18. As a result, an equal pressure of the electrode 22a can be applied on each of the conductive wires 7 and the terminals 13 and also heat generation can be limited.

Figure 19:
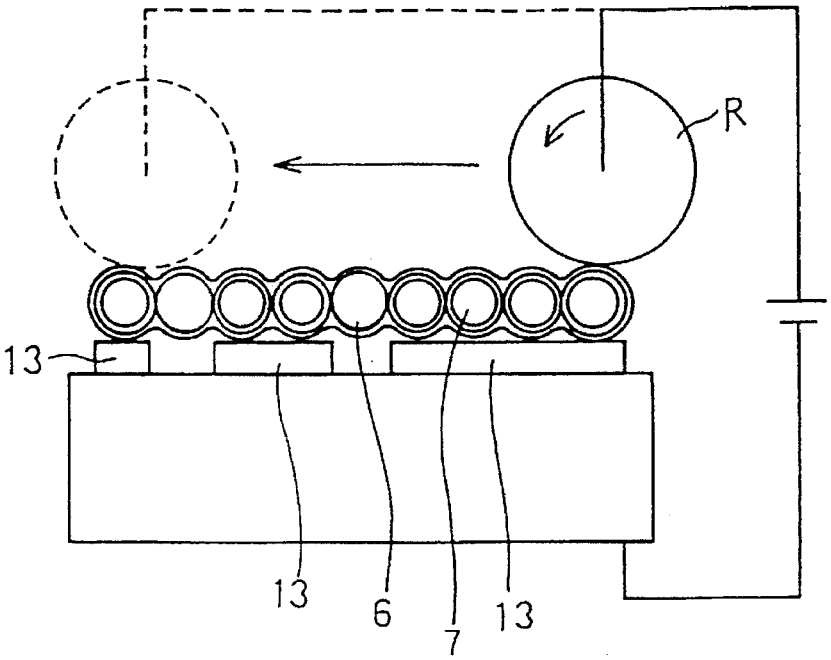
FIG. 19 is a perspective view illustrating the connection of the flat cable according to the present invention to terminals of devices by another way of fusion welding.
Figure 20:
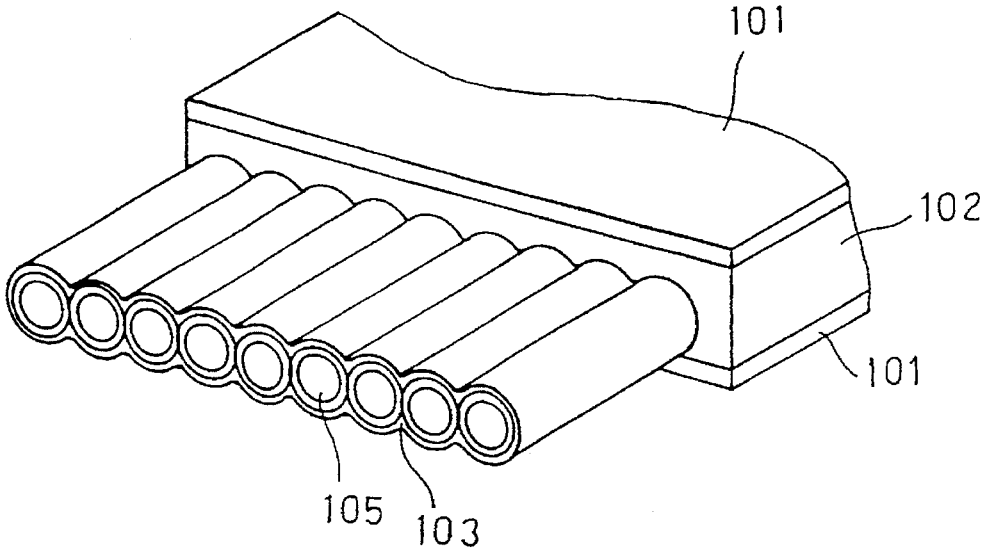
FIG. 20 PRIOR ART
FIG. 20 is a perspective view illustrating a conventional flat cable.
Figure 21:
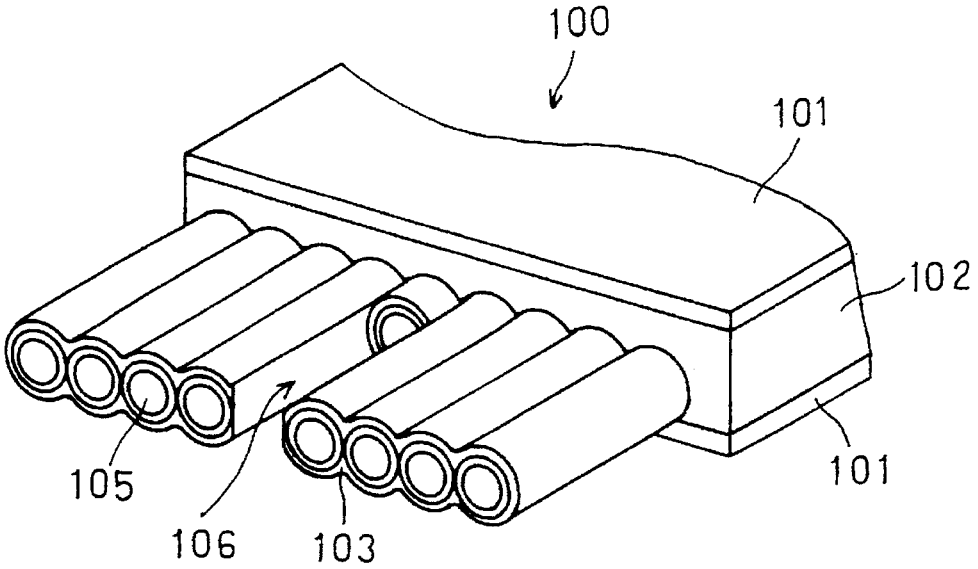
FIG. 21 is a perspective view illustrating a flat cable processed for connection.
Figure 22:
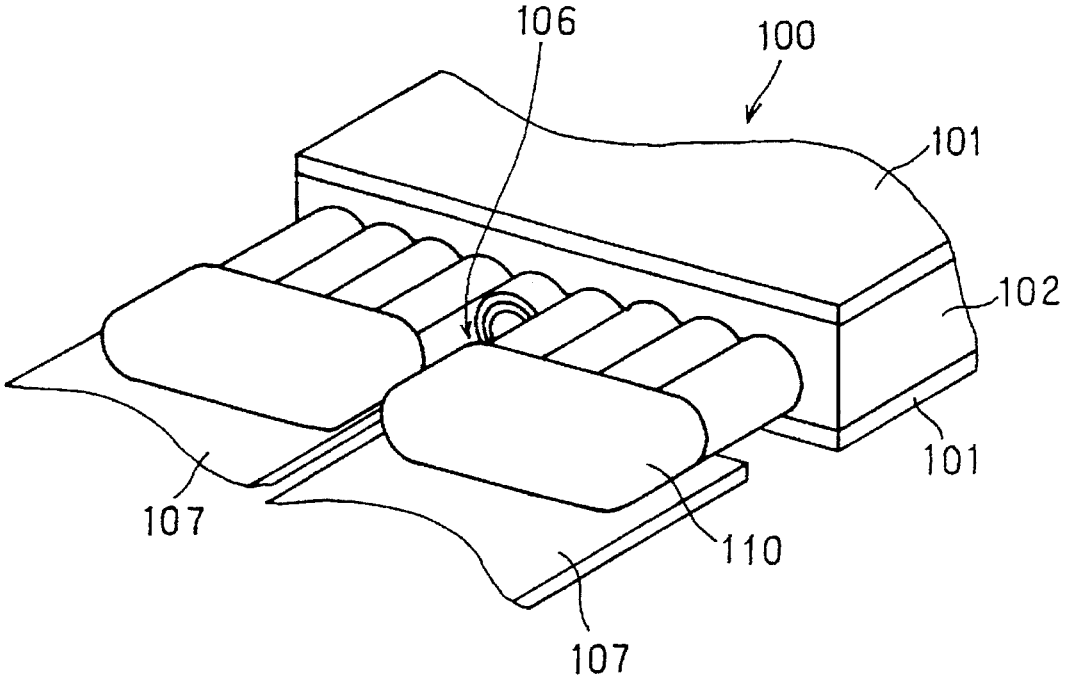
FIG. 22 is a perspective view illustrating connection of the flat cable shown in FIG. 21 to terminals of devices by soldering.
Figure 23:
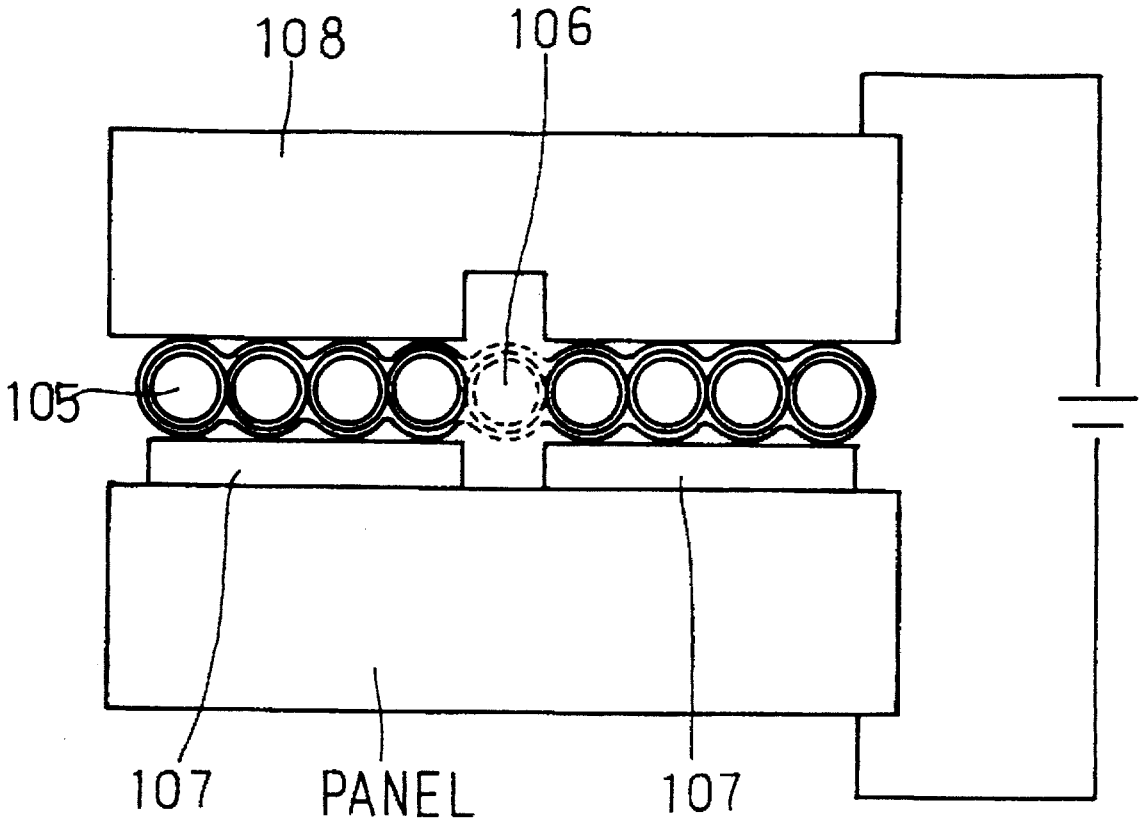
FIG. 23 is a perspective view illustrating the connection of the flat cable shown in FIG. 21 to terminals of devices by fusion welding.

The fusion welding also can be carried by a roller electrode 'R' which is rotatable on the wires 6 and 7 of the flat cable as shown in FIG. 19. Each of the fusion welding connection of each of the conductive wires 7 to a terminal of some device is carried when the roller electrode 'R' is positioned on each of the conductive wires 7 by applying fusion voltage and pressure. As a result, a uniform fusion welding connection is obtained in a simple process.

In the foregoing discussion of the present invention, the invention has been described with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than a restrictive, sense.

What is claimed is:

1. A flat cable for connecting terminals of a plurality of different electric devices, said flat cable comprising:

a plurality of conductive wires disposed in a flat board shape, each of said conductive wires having a same value of electric resistance;

at least one insulating wire interposed between said conductive wires for dividing said conductive wires into a plurality of channels to have values of electric resistance specific to said electric devices to be connected and at least one of said channels has a resistance value different from another of said channels; and a holder member for holding said conductive wires and said at least one insulating wire in a flat board shape.

2. A flat cable claimed in claim 1 further comprising a plurality of additional insulating wires for disposing said channels to correspond to each position of said terminals of said electric devices.

3. A flat cable claimed in claim 1 further comprising a plurality of additional insulating wires disposed on opposite sides of said conductive wires thereby protecting said conductive wires held in said flat board shape.

4. A flat cable claimed in claim 1, wherein each of said conductive wires comprises an insulation coating formed therearound.

5. A flat cable for connecting terminals of a plurality of different electric devices, said flat cable comprising:

a plurality of conductive wires each having a same fixed value of resistance and disposed in a flat board shape;

at least one insulating wire interposed between said conductive wires for dividing said conductive wires into a plurality of different channels to be connected to said different electric devices, each of said channels having a specific resistance value which is inversely proportional to the number of said conductive wires thereof to match one of said devices to be connected and at least one of said channels having a resistance value different from another of said channels;

a holder member for holding said conductive wires and said at least one insulating wire in a flat board shape; and a sheet of film and adhesive material covering said holder member for protecting said conductive wires.

6. A flat cable claimed in claim 5 further comprising at least two additional insulating wires respectively disposed on opposite sides said conductive wires thereby protecting said conductive wire.

7. A flat cable claimed in claim 5, wherein said at least one insulating wire has the same diameter as said conductive wires.

8. A flat cable claimed in claim 7, wherein opposite sides of said sheet of film comprise retaining members to retain said conductive wires in said holder member when said holder member is melted by heat and pressed from outside.

9. A flat cable claimed in claim 7 further comprising a plurality of additional insulating wires disposed between adjacent two of said channels to position each of said channels to correspond to one of said terminals of said electric devices.

10. A flat cable claimed in claim 7, wherein each of said conductive wires comprises an insulation coating formed therearound.

11. A flat cable claimed in claim 7, wherein said holder member comprises an insulation member directly covering said conductive wires.

12. A flat cable claimed in claim 7, wherein said conductive wires have rectangular cross-section.

13. A flat cable for connecting terminals of different electric devices, said flat cable comprising:

a plurality of conductive wires each having a diameter and a common resistance and disposed generally on a common plane;

a plurality of insulating wires having a same diameter as said conductive wires, said insulating wires being interposed between said conductive wires to divide said conductive wires into different channels having specific resistances to be connected to different devices respectively, and at least one of said channels having a resistance value different from another of said channels; and an insulating holder member for holding said conductive wires and said insulating wires in a generally planar configuration.

14. A flat cable claimed in claim 13 further comprising a plurality of additional insulating wires for disposing said channels to correspond to said terminals of said electric devices.

15. A flat cable claimed in claim 13 further comprising a couple of additional insulating wires respectively disposed outside said conductive wires.

* * * * *